US006079473A

United States Patent [19]

Ackerson, II et al.

[11] Patent Number: 6,079,473

[45] Date of Patent: Jun. 27, 2000

[54] REMOVABLE SCREEN APPARATUS

[76] Inventors: Wade A. Ackerson, II, 14192 152nd Ave.; Daniel J. Davis, II, 14190 152nd Ave., both of Grand Haven, Mich. 49417

[21] Appl. No.: 09/038,516

[22] Filed: Mar. 11, 1998

Related U.S. Application Data

[60] Provisional application No. 60/040,670, Mar. 11, 1997.

[51] Int. Cl.[7] ..... A47H 13/00

[52] U.S. Cl. ..... 160/368.1; 160/327; 160/354; 160/DIG. 18; 52/202

[58] Field of Search ..... 160/368.1, 354, 160/327, 330, 89, DIG. 18; 52/202

[56] References Cited

U.S. PATENT DOCUMENTS

| | | | |
|---|---|---|---|
| D. 334,067 | 3/1993 | Helka . | |
| D. 341,429 | 11/1993 | Welch . | |
| D. 357,071 | 4/1995 | Jennings et al. . | |
| 2,246,663 | 6/1941 | Bradshaw | 156/14 |
| 2,886,481 | 5/1959 | Swan | 154/116 |
| 2,925,862 | 2/1960 | Sundby | 160/354 |
| 3,004,592 | 10/1961 | Norton | 160/368.1 X |
| 3,205,628 | 9/1965 | Frisk | 52/222 |
| 3,251,399 | 5/1966 | Grossman | 160/180 |
| 3,455,366 | 7/1969 | Bogumil | 160/368 |
| 3,480,069 | 11/1969 | Handwerker | 160/354 |
| 3,753,458 | 8/1973 | Lazarek | 160/354 |
| 3,763,917 | 10/1973 | Antinone | 160/354 |
| 4,031,942 | 6/1977 | Shelton | 160/103 |
| 4,053,008 | 10/1977 | Baslow | 160/327 |
| 4,100,957 | 7/1978 | Shelton | 160/368 R |
| 4,161,977 | 7/1979 | Baslow | 160/327 X |
| 4,249,589 | 2/1981 | Loeb | 160/368 R |
| 4,337,815 | 7/1982 | Lindstrom | 160/327 X |
| 4,399,640 | 8/1983 | Porter | 160/368.1 X |
| 4,651,797 | 3/1987 | Lange | 160/290 F |
| 4,673,019 | 6/1987 | Silverthorne et al. | 160/268 R |
| 4,712,598 | 12/1987 | Bonacci et al. | 160/84 R |
| 4,846,241 | 7/1989 | Chomka et al. | 160/23.1 |
| 4,909,004 | 3/1990 | Panttila | 52/208 |
| 4,972,896 | 11/1990 | Roberts | 160/354 |
| 5,271,449 | 12/1993 | Herrick | 160/368.1 |
| 5,323,835 | 6/1994 | Bachmeier | 160/89 |
| 5,345,989 | 9/1994 | Brophy | 160/354 |
| 5,358,025 | 10/1994 | Wood | 160/368.1 |
| 5,427,169 | 6/1995 | Saulters | 160/368.1 |
| 5,850,864 | 12/1998 | Decker | 160/368.1 X |

*Primary Examiner*—Daniel P. Stodola
*Assistant Examiner*—Bruce A. Lev
*Attorney, Agent, or Firm*—Price Heneveld Cooper DeWitt & Litton

[57] ABSTRACT

The removable screen for covering a building opening includes elongated channels configured for attachment to building structure defining a large building opening; and a screen member configured for releasable attachment to the elongated channels. The screen member includes a screen panel permitting light and air to pass there through but preventing insects from passing therethrough, and border strips attached to three sides of the perimeter of the screen panel. The border strip is configured to slidably engage the elongated channels to retain the screen member over the garage door opening. An elastic strip is attached along at least one side of the perimeter, and a zipper attached between the border strip and the zipper.

17 Claims, 4 Drawing Sheets

REMOVABLE SCREEN APPARATUS

CROSS-REFERENCE TO RELATED APPLICATIONS

This application claims benefit under 35 U.S.C. §119(e) of the filing date of U.S. Provisional Application No. 60/040,670, filed on Mar. 11, 1997, the entire disclosure of which is incorporated by reference herein.

BACKGROUND OF THE INVENTION

The present invention relates to the removable screen apparatus for covering openings in buildings such as garage door openings, though not limited to this single application.

Many people use their garages as an extra large room for having parties and receptions therein, such as graduation parties, reunions, and the like. Still other people use the garage door as an open area in which they can sit, play cards, or otherwise enjoy themselves. However, it is desirable to open a garage door to allow air and light into the garage without also allowing insects such as mosquitos into the garage. Screens will work for this purpose, but they can be problematic to install and to remove. Further is takes some ingenuity to make the screens secure but removable, attractive, and low cost. Another problem for manufacturers of prefabricated screening systems is that garage door opening sizes vary from building to building, such that it is difficult to mass produce a single screen element that will satisfactorily completely cover garage door openings, but that will not also wrinkle and/or leave gaps around the garage door opening. Further, long-lasting screen constructions tend to be unacceptably heavy and/or non-durable. Further, initial installation is cumbersome, as well as later removal and/or re-installation in the following season. Still further, it is desired to provide a pass-through opening in the screen permitting pass-through of vehicles and/or people through the screen. Also, it is desirable to construct a screen construction that is independent of the garage door and that can be left in place even while the garage door is being opened or closed. These problems are particularly exasperated due to variations between garage door opening sizes and building constructions, and where consumer demand justifies only low volume runs.

Therefore, a removable screen apparatus for covering garage door openings or other large building openings is desired.

SUMMARY OF THE INVENTION

In one aspect, the present invention includes an apparatus for covering a building opening with a screen, such as a garage door opening. The apparatus includes elongated channels configured for attachment to a building structure in an inverted U-shaped arrangement around the building opening, and a screen member configured to slidably releasably engage the elongated channels. The screen member includes a screen panel generally the size of the building opening for covering the opening while permitting light and air to pass there through, but for also preventing insects from passing there through. A border strip is attached to three sides of the perimeter of the screen panel, the border strip being configured to slidably engage the elongated channels. An elastic strip is attached along one or both vertical sides of the perimeter to allow the screen member to compensate for building opening dimensional variations. In a preferred form, a vertically extending zipper is attached between the screen panel and the border strip, or between the border strip and the elastic to allow easy ingress and egress through the screen.

In another aspect of the present invention, a method includes providing elongated channels around the sides and top of a building opening; and providing a screen member having border strips configured to slidably engage the elongated channels. The method further includes inserting the border strip of the screen member longitudinally into the channels to secure the screen member in place to cover the building opening. In one form, the horizontally extending top border is slid into position, and thereafter the opposing side border strips are slid into the side channels from top to bottom by flexing the side boarder strips as the side border strips are fed into the top of the elongated channels on the side members.

These and other features advantages and objects of a the present invention will be further understood and appreciated by those skill in the art bear reference to the following specification claims and dependent drawings.

DETAILED DESCRIPTION OF PREFERRED EMBODIMENT

Figure 1:
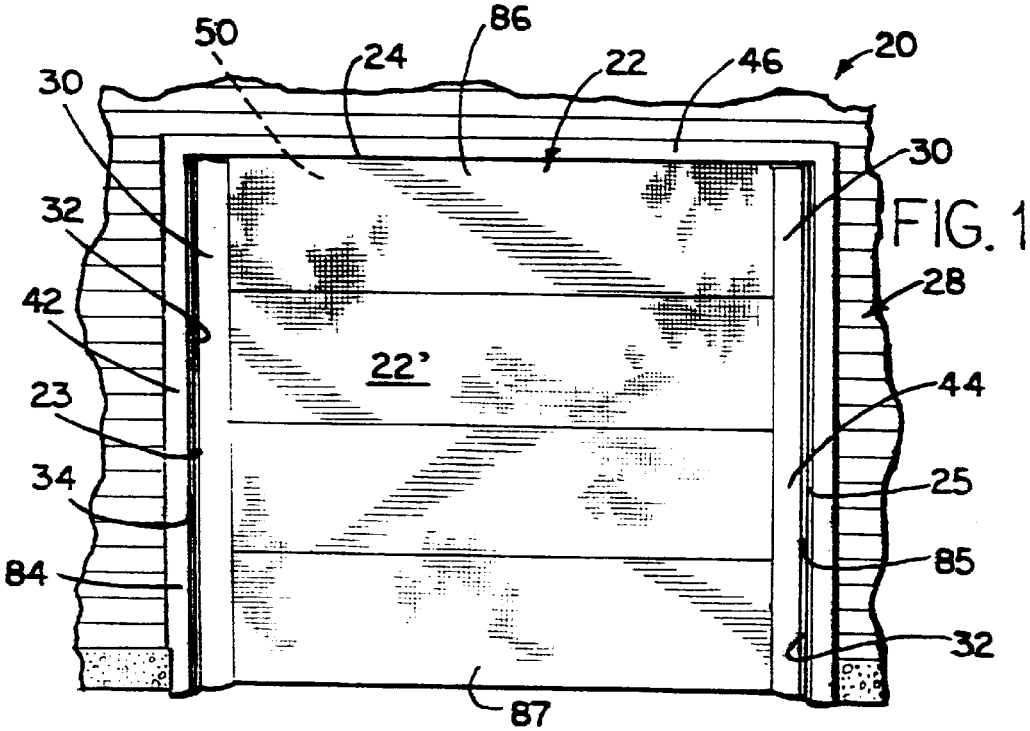
FIG. 1 is a front elevational view of a screen apparatus covering a garage door opening embodying the present invention, the garage door being in a closed position.

For purposes of description herein, the terms "upper", "lower", "right", "left", "front", "rear", "vertical", "horizontal", and derivatives thereof shall relate to the invention as oriented in FIG. 1. However, it is to be understood that the invention may assume various alternative orientations. It is further to be understood that the specific devices and processes illustrated in the attached drawings and described in the following specification are simply exemplary embodiments of the inventive concepts defined in the dependent claims. Hence, specific dimensions and other physical characteristics relating to the embodiments disclosed herein are not to be considered as unnecessarily limiting, unless the claims expressly state otherwise.

A screen apparatus 20 (FIG. 1) includes a screen member 22 attachable to elongated channels 23, 24, and 25 attached around a garage door opening 26 of a building structure 28.

Screen member 22 includes a screen panel 22' and further includes a border strip 27 that extends around the screen panel 22' and that is longitudinally slidably attachable to elongated channels 23–25 to permit easy installation and removal. Screen member 22 also includes an elastic strip 30 permitting some expansion of screen member 22 so that screen member 22 can be prefabricated for later attachment to a particular building opening 26 despite variations in dimensions of garage door openings from building to building. Further, screen member 22 includes a pair of zippers 32 that can be unzipped to permit access through screen member 22 into and out of the garage area. Advantageously, the present screen apparatus 20 is constructed from relatively inexpensive and lightweight components and is adaptable for use in various buildings despite dimensional variations in garage door openings such that the screen apparatus can be mass produced.

Figure 2:
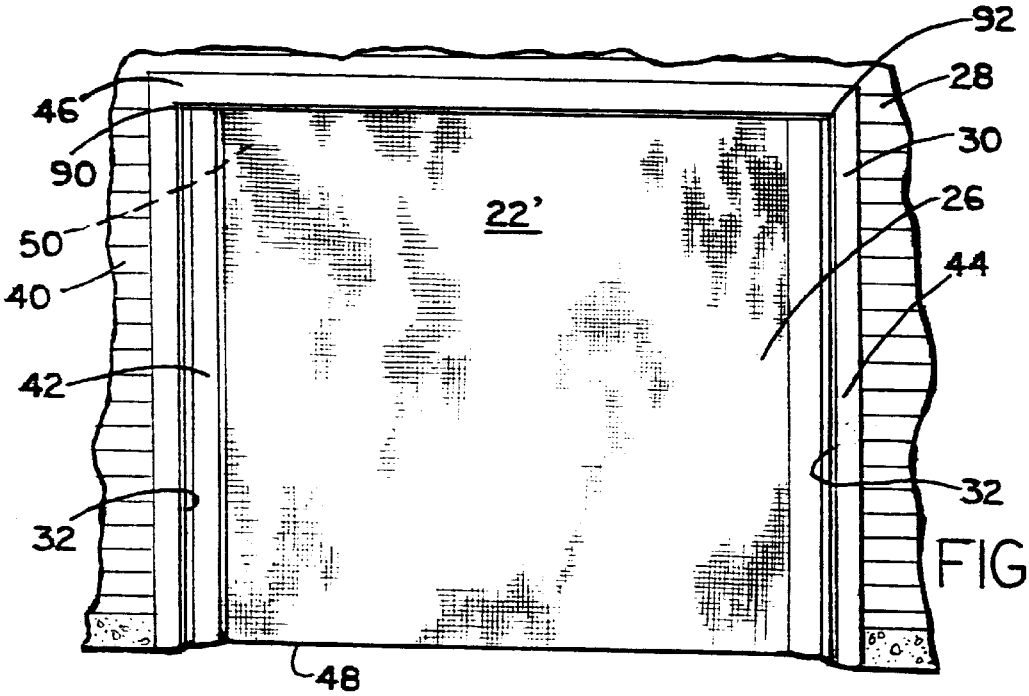
FIG. 2 is a front elevational view of the screen apparatus shown in FIG. 1, the garage door being in an open position.
Figure 3:
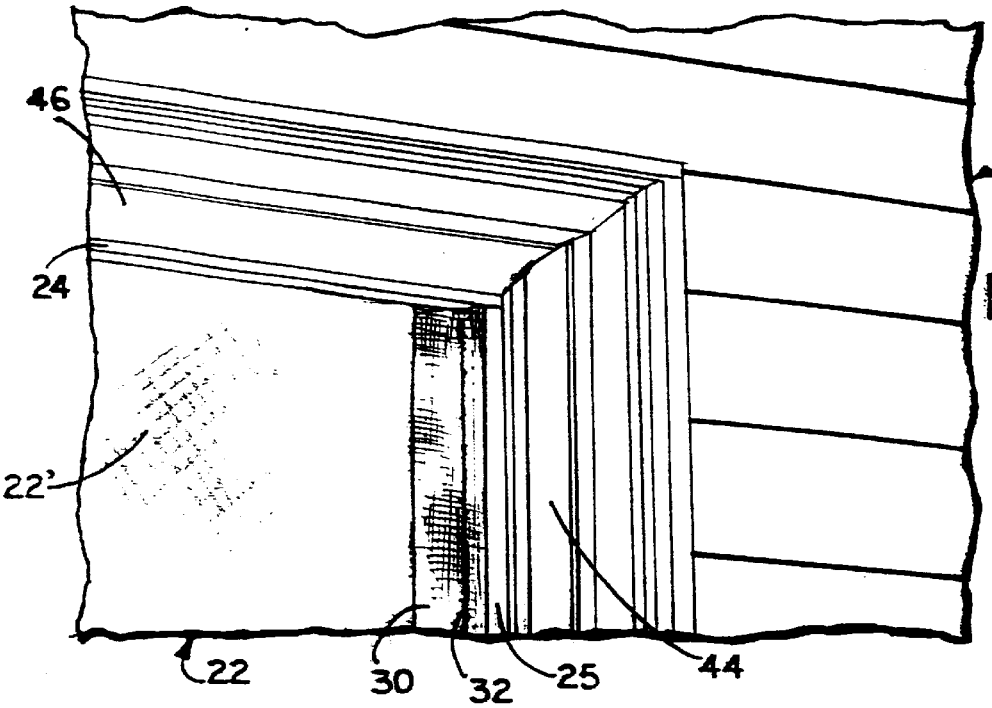
FIG. 3 is an enlarged fragmentary perspective view of an upper corner of the garage door opening and the screen apparatus shown in FIG. 1.
Figure 5:
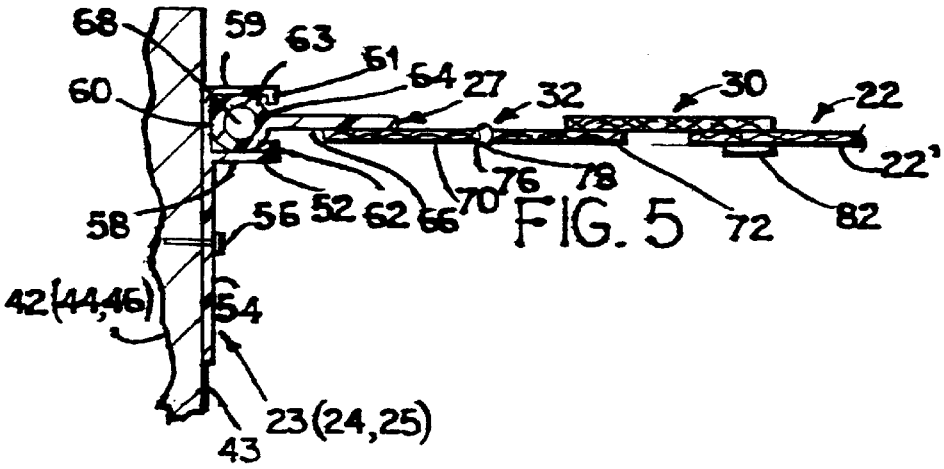
FIG. 5 is an enlarged, fragmentary cross-sectional view taken along the plane V—V in FIG. 4.

Building 40 (FIG. 2) includes vertical structural members 42 and 44 and horizontal upper structural member 46 that define a garage door opening 26 over a floor/driveway 48. Vertical structural members 42, 44 and horizontal structural member 46 include inwardly facing surfaces having a depth of several inches that define opening 26. A garage door 50 is mounted on tracks 51 (FIG. 6) within the garage for movement between a closed position (FIG. 1) wherein the garage door 50 is positioned slightly behind but generally completely covering garage door opening 26, and an open position (FIG. 2) wherein the garage door 50 is moved vertically and then horizontally along a track into a horizontal raised position. Elongated channels 23–25 (FIG. 5) are extruded from a stiff polymer such as PVC or the like commonly used in window jambs or in curtain tracks. Channels 23–25 each include a channel defining section 52 and an attachment flange section 54. Flange section 54 is configured to lie substantially flat against surfaces 43 of structural members 42, 44, and 46, and can be attached by a fastener 56 such as a nail, screw or staple driven through flange section 54 into structural member 42 (or 44 or 46). Channel defining section 52 is generally rectangular and includes side walls 58 and 59, bottom wall 60 and opposing slot-defining wall sections 61 and 62 defining a pocket 63. Slot-defining wall sections 61 and 62 define an inlet slot 64. We have found that an existing extrusion in the form of a household "curtain track" commonly used to hold curtains over building windows can be used for channels 23–25.

Border strip 27 (FIG. 5) includes an attachment flange 66 and a bulbous channel-engaging section 68. Border strip 27 is constructed from a pliable, resilient material such as a rubber like material that can be easily bent and collapsed, but that is stiff enough to maintain its shape and bear some stress. The bulbous section 68 is hollow to facilitate the extrusion of bulbous section 68. Bulbous section 68 has a diameter substantially larger than inlet 64 and is configured to slip longitudinally and easily into the pocket 63 defined by elongated channel 24.

Figure 4:
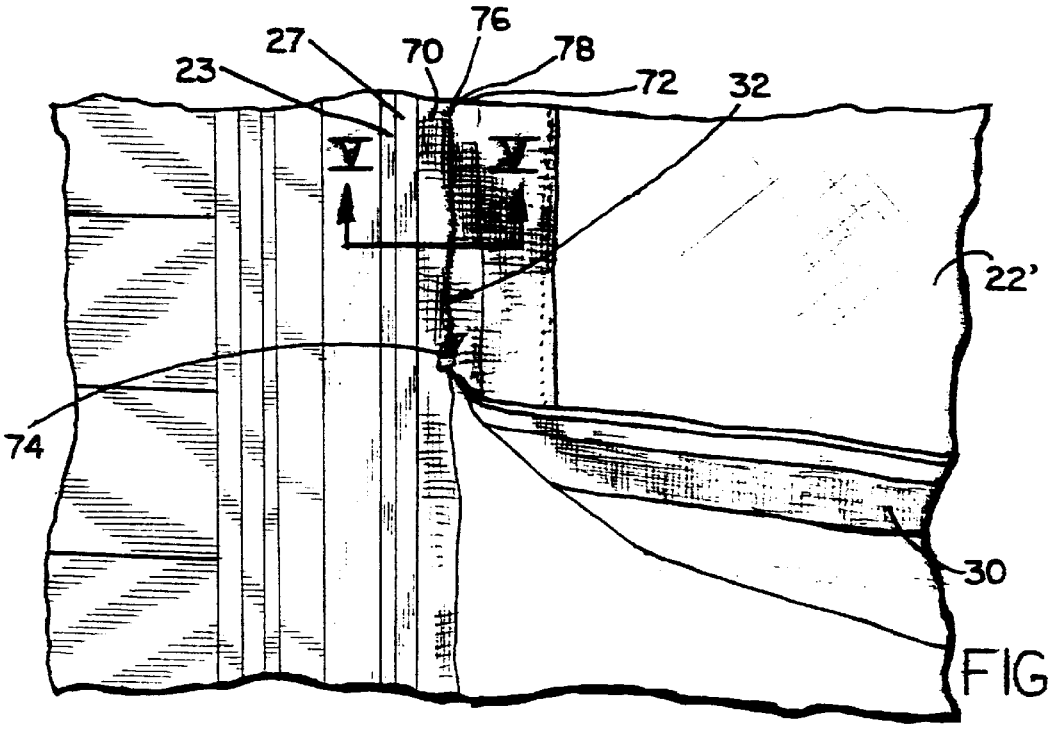
FIG. 4 is an enlarged fragmentary perspective view of the screen apparatus, the zipper of the screen apparatus being partially unzipped.

Zipper 32 (FIG. 4) includes an outer fabric strip 70, an inner fabric strip 72 and a zipper head 74 configured to engage and disengage zipper elements 76 on outer strip 70 and zipper elements 78 on inner strip 72. Outer zipper strip 70 is sewn to attachment flange 66 of border strip 27. The elastic strip 30 is sewn to inner zipper strip 72, and extends screen panel 22' inwardly about 2–4 inches and is sewn to the opposite side of elastic strip 30 from zipper 32 by conventional sewing methods, such as by use of a reinforcement strip 82.

Screen member 22 (FIG. 1) defines left and right sides 84 and 85, a top 86 and a bottom 87. Zipper 32 and elastic strip 30 extend from top 86 to bottom 87 on at least left side 84. Another zipper 32 and/or elastic strip 30 can also be attached to right side 85 for aesthetics or for functional reasons if desired. However, it is contemplated that only a single zipper 32 and elastic strip 30 are needed. Across top 86, screen panel 22' and reinforcement strip 82 are attached directly to border strip 34.

Figure 6:
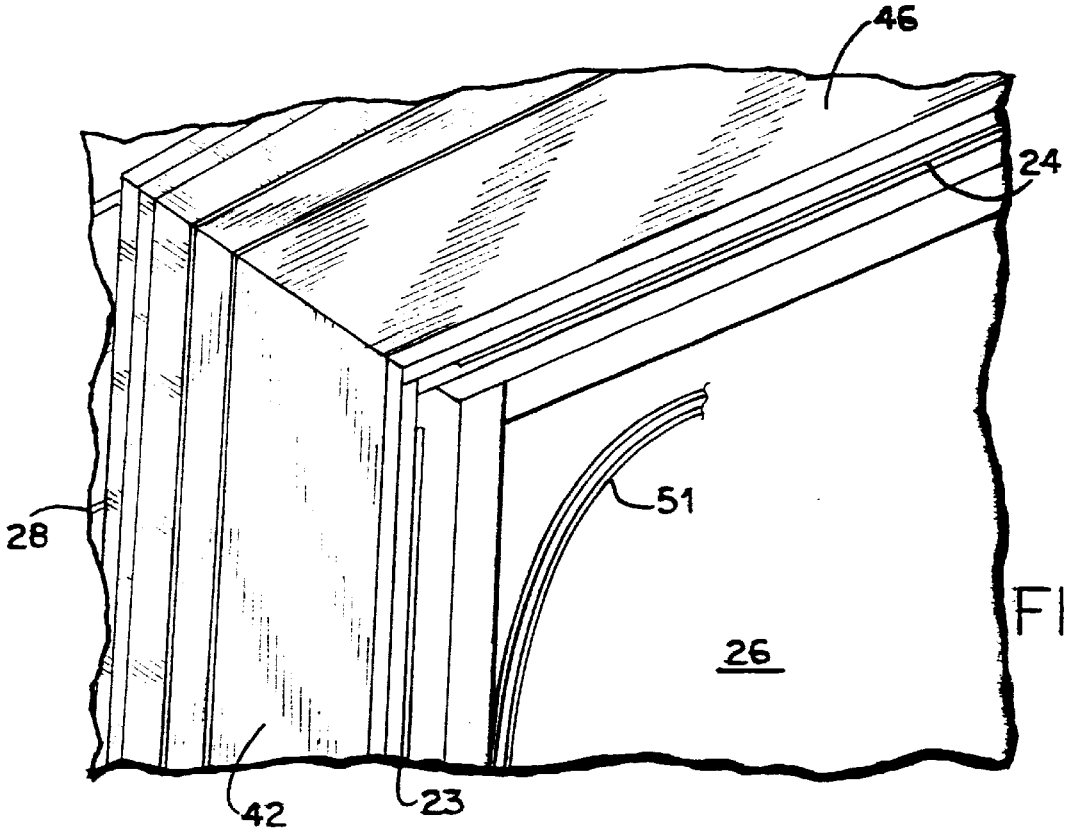
FIG. 6 is a perspective view of the upper left-hand corner of the garage door opening from an exterior side of the garage door opening, showing the elongated channels attached to the garage door opening.
Figure 7:
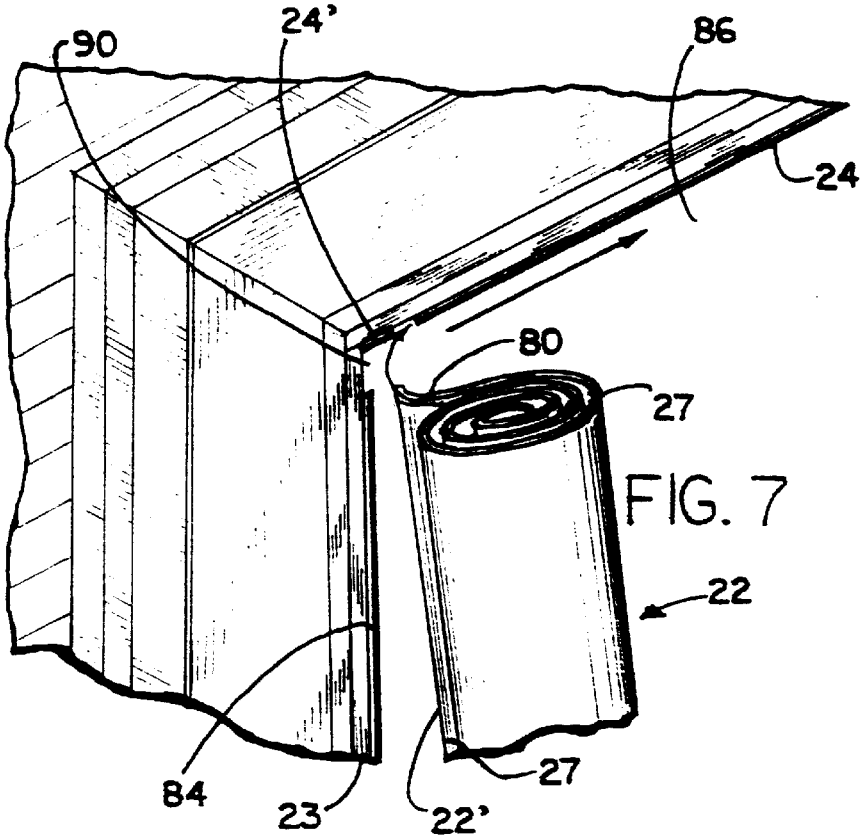
FIG. 7 is a fragmentary perspective view showing a first step of a method of installation including inserting the border strip of the screen member longitudinally into the horizontal channel member attached to the garage structure above the garage door opening.

A border strip 27 is sewn to the sides and top of screen member 22. It extends completely from top to bottom on left side 84 and right side 85 of screen member 22, and also is extended substantially across top section 86. Notably, the border strip 27 includes a gap 80 and is discontinuous at the top of elastic strip 30 (FIG. 7) so that elastic strip 30 can stretch across the span of elastic strip 30 without being restricted by the border strip along top side 86. Also, it is noted that elongated channels 24 extend substantially entirely along sides 84 and 85 and top 86. However, elongated channels 24 are cut about 2 inches short of the upper left-hand corner and are cut about 2 inches short of the upper right-hand corner so that border strips 27 can be slidably inserted therein, as illustrated in FIG. 6 and as described below. Notably, a short section of channel 24' can be attached at the corner of the garage door opening to better hold the screen member 22, as shown in FIG. 7. Screen member 22 is fabricated so that it is about 1 to 2 inches longer vertically than the opening of garage door opening 26 so that it drapes into floor 48 to close any openings caused by an uneven floor 48. It is also contemplated that the bottom of the screen member 22 can be weighted, or can form a sleeve for receiving a tubular piece to facilitate rolling up the screen for storage, or a combination of both. Also, a pull cord (not specifically shown) can be attached overhead and to the sleeve/tubular member to provide a quick-raise feature for lifting/raising the screen.

Figure 8:
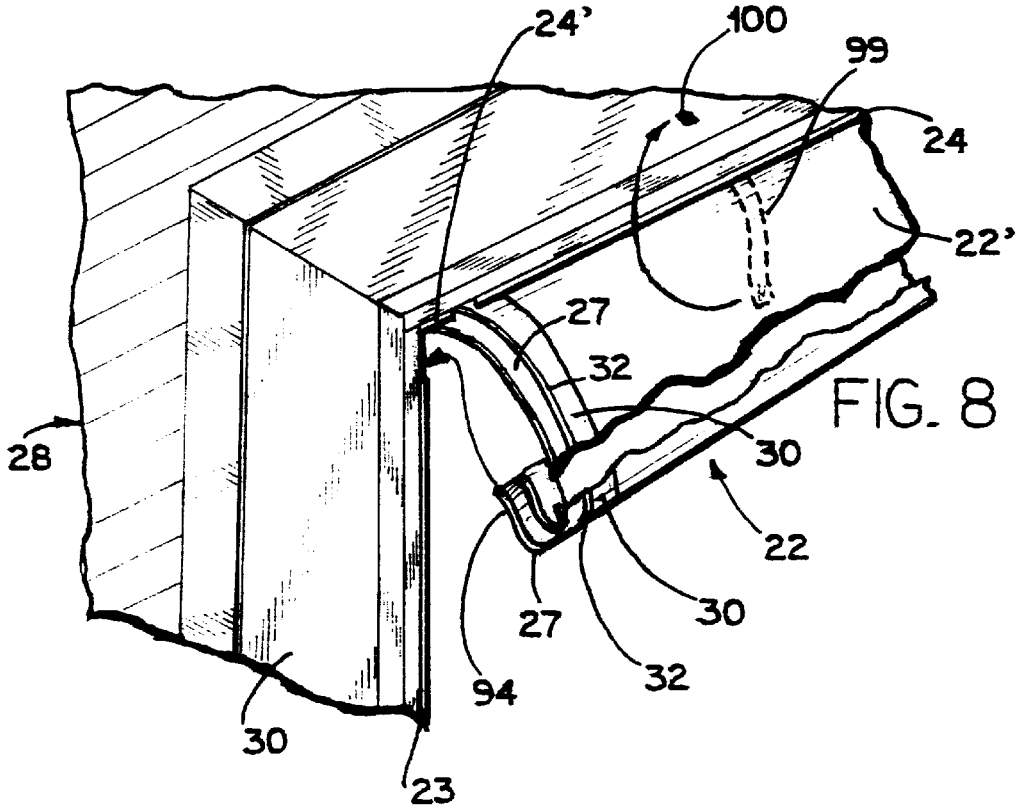
FIG. 8 is a fragmentary perspective view showing a second step of a method of installation including inserting the bottom of the screen member into the top of the vertical channels attached to the side of the garage door opening building structure.

To install screen member 22, the border strip 34 extending along the top side 86 of screen member 22 is slidably inserted from a left-hand upper corner 90 longitudinally into the channel 24 at the top of garage door opening 26. Thereafter, the bottom end 94 of a side border strip 27 is resiliently flexed and inserted into the top of elongated channel 24 (FIG. 8). Simultaneously, the bottom end of the right-hand side border strip of screen member 22 is inserted in the right-hand side of the elongated vertical channel from the top toward the bottom. Alternatively, one or both of the zippers 32 can be unzipped to facilitate installation on the left and the right sides one at a time. Thus, screen member 22 is slidably installed by flexing border strips 27. Notably, the corners 90 and 92 (FIG. 2) are adequately and tightly covered by screen member 22 due to the stiffness of border strip 34. Where desired, a short section of elongated channel such as short channel section 24' can be attached at the corners 90 to better define the corner and retain the corner of screen member 22 in position. A strap 99 and snap 100 (FIG. 8) are attached to the top of the garage door opening structure to hold the unzipped screen member 22 in a rolled up condition at the top of the garage door opening when the screen apparatus 20 is not is use, but when it is desirable to leave it installed. It is contemplated that the snap 100 can be replaced with another releasable fastener, such as hook and loop material.

Thus, a removable screen for covering garage door openings and other large building openings is provided. The removable screen apparatus includes channels attached to the building structured defining the garage door opening, and further includes a screen member having a screen panel for permitting entrance of light and air into the garage door opening but preventing entrance of mosquitos and insects.

The screen member further includes a flexible border strip that is slidably longitudinally attachable to the channels around the garage door opening. The screen member still further includes an elastic strip that allows the screen member to stretch and compensate for garage door openings that vary somewhat in size from building structure to building structure. Also, the screen member includes a zipper that permits entrance and egress through the screen member, but which is thereafter recloseable to prevent insects from bypassing the screen member.

The invention claimed is:

1. A screen apparatus for covering a building opening defined by a building structure comprising:

a plurality of elongated channels configured for attachment to the building structure around the building opening; and a screen member configured for releasable attachment to the elongated channels including a screen panel, a border strip attached along side edges of the screen panel and configured to longitudinally slidably engage the channels in a retaining fashion that prevents lateral removal, a flexible bulbous top edge for longitudinally slidably engaging a top elongated channel for hangingly supporting the screen member from a top frame of the building opening, an elastic strip attached to the border strip, the elastic strip of greater elasticity than the screen panel and permitting the screen member to stretch to compensate for dimensional differences in the size of the particular building opening from an expected opening size, and an access zipper attached intermediate to one of the screen panel, the elastic strip, and the border strip for permitting selective access through the screen member, the zipper being selectively movable between an open position and a closed position.

2. The apparatus of claim 1 wherein the elongated channels are extruded from a stiff polymer.

3. The apparatus of claim 2 wherein the stiff polymer is polyvinyl chloride.

4. The apparatus of claim 3 wherein the elongated channels further include an attachment flange adapted to receive a fastener to attach the elongated members to the building structure.

5. The apparatus of claim 1 wherein the border strip is constructed from a pliable, resilient material.

6. The apparatus of claim 5 wherein the pliable, resilient material is rubber.

7. The apparatus of claim 1 wherein the elongated channels are rectangular and define an inlet opening.

8. The apparatus of claim 7 wherein the border strip on the side edges of the screen member further includes a bulbous section.

9. The apparatus of claim 8 wherein the bulbous section has a diameter substantially larger than the inlet of the elongated channels.

10. The apparatus of claim 9 wherein the border strip is sewn to sides of the screen panel and extends from a top to a bottom of the panel.

11. The apparatus of claim 10 wherein the border strip includes a gap and is discontinuous at a corner defined at the top of the elastic strip to allow the elastic strip to stretch across and span a distance without being restricted by the border strip at the corner.

12. The apparatus of claim 1 wherein the screen member includes a flimsy bottom section so that the screen member is a few inches longer vertically than the anticipated height of a building opening to close any openings defined by an uneven floor and a bottom of the screen member.

13. The apparatus of claim 1 wherein the screen member is weighted along a bottom edge.

14. The apparatus of claim 1 wherein the screen member forms a sleeve along a bottom edge for receiving a tubular member to facilitate rolling up the screen for storage.

15. The apparatus of claim 14 further including a pull cord attached to the sleeve to provide a quick-raise feature for lifting the screen.

16. The apparatus of claim 1 further including a second zipper selectively movable between an open position and a closed position and attached to an opposite side of the screen member from the first zipper to permit the screen member to be unzipped and opened from both of its sides.

17. A method includes:

attaching channels to opposing sides and horizontal top structure of a garage door opening;

providing a screen member having a bulbous border along a top edge and opposing side edges and configured to slidably engage the channels;

longitudinally slidably engaging the bulbous border of the top edge of the screen member within the channel attached to the horizontal top structure of the garage door opening; and longitudinally slidably engaging the bulbous border of the opposing side edges of the screen member with the channels on the opposing sides of the garage door opening to secure the screen member to cover the garage door opening.

* * * * *